US007489898B2

(12) United States Patent
Hayashi

(10) Patent No.: US 7,489,898 B2
(45) Date of Patent: Feb. 10, 2009

(54) SHEET PROCESSING APPARATUS AND IMAGE FORMING APPARATUS PROVIDED WITH THE SAME

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 666 days.

(21) Appl. No.: 11/179,515

(22) Filed: Jul. 13, 2005

(65) Prior Publication Data

US 2006/0018694 A1 Jan. 26, 2006

(30) Foreign Application Priority Data

Jul. 20, 2004 (JP) ..... 2004-211807
Jul. 6, 2005 (JP) ..... 2005-197628

(51) Int. Cl.
*G03G 15/00* (2006.01)

(52) U.S. Cl. ..... 399/406; 399/407

(58) Field of Classification Search ..... 399/306, 399/407; 271/209
See application file for complete search history.

(56) References Cited

U.S. PATENT DOCUMENTS 3,387,836 A 6/1968 Stookey
5,897,250 A 4/1999 Hirai et al. ..... 399/404
5,911,414 A 6/1999 Kato et al. ..... 270/58.07
6,241,234 B1 6/2001 Saitoh et al. ..... 270/58.12
6,264,194 B1 7/2001 Hayashi et al. ..... 271/220
6,290,220 B1 9/2001 Takehara et al. ..... 270/58.12
6,526,256 B2 * 2/2003 Yoshie et al. ..... 399/407
7,344,130 B2 * 3/2008 Kamiya et al. ..... 270/37
2005/0179190 A1 8/2005 Kamiya et al. ..... 270/58.07
2006/0017209 A1 1/2006 Kushida et al. ..... 270/37
2006/0017218 A1 1/2006 Kawata et al. ..... 271/207
2006/0018694 A1 1/2006 Hayashi ..... 399/406
2006/0019811 A1 1/2006 Ikeda et al. ..... 493/444

FOREIGN PATENT DOCUMENTS

JP 60015348 A * 1/1985
JP 2000-153947 6/2000

* cited by examiner

*Primary Examiner*—Daniel J Colilla
*Assistant Examiner*—Allister Primo
(74) *Attorney, Agent, or Firm*—Fitzpatrick, Cella, Harper & Scinto

(57) ABSTRACT

A sheet processing apparatus includes a curling unit which curls an end portion of a sheet, and a folding device which is disposed downstream of the curling unit and folds a sheet or a sheet bundle curled by the curling unit. The folding device folds the sheet bundle so that the end portion of the sheets curled by the curling unit may face inwardly.

11 Claims, 14 Drawing Sheets

SHEET PROCESSING APPARATUS AND IMAGE FORMING APPARATUS PROVIDED WITH THE SAME

BACKGROUND OF THE INVENTION

1. Field of the Invention

The invention relates to a sheet processing apparatus which folds a sheet bundle, and particularly almost prevents the open ends of a folded sheet bundle from opening, and an image forming apparatus provided with this sheet processing apparatus in a main body of the image forming apparatus.

2. Related Background Art

There is, for example, a sheet processing apparatus which binds sheets into a bundle shape. This sheet processing apparatus is adapted to be capable of performing the processing of making sheets into a bundle shape and needle-binding the bundle at its intermediate portion, and then folding it into the shape of a pamphlet (so-called booklet (saddle-stitched book) making, i.e., saddle stitching). Such a sheet processing apparatus is sometimes provided as a constituent of an image forming apparatus in the apparatus main body of the image forming apparatus (see Japanese Patent Application Laid-Open No. 2000-153947).

FIG. 14 of the accompanying drawings shows the image forming apparatus provided with that sheet processing apparatus. The conventional sheet processing apparatus 901 shown in FIG. 14 is adapted to be capable of performing the above-mentioned saddle stitching, the aligning process of aligning the end portion of a sheet bundle (so-called sorting process), the side stitching of binding the end portion of the sheet bundle (so-called staple sorting process), etc.

The conventional sheet processing apparatus 901 performs the saddle stitching in the following manner. The sheet processing apparatus 901 stacks sheets successively received from the apparatus main body 903 of the image forming apparatus 902 onto a saddle stitching tray 910 formed steeply and substantially straight, receives the sheets by a stopper 911 and makes them into a bundle shape. Then, a width aligning device (not shown) performs the width aligning of the sheets P. Thereafter, an intermediate portion stapler unit 912 binds the sheet bundle at two locations near the substantially central portion thereof. The stopper 911 is moved up and down to thereby oppose the bound portions of the bound sheet bundle to the nip between a pair of folding rollers 914 and a thrusting plate 913. The thrusting plate 913 thrusts the bound portions of the sheet bundle and sends the sheet bundle into the nip between the pair of folding rollers 914. The pair of folding rollers 914 fold the sheet bundle into two while nipping and conveying the sheet bundle. Lastly, a pair of discharging rollers 915 discharge the sheet bundle onto a sheet stacking portion 905. As described above, the conventional sheet processing apparatus 901 can make the sheet bundle into the shape of a twice-folded pamphlet.

Also, the sheet processing apparatus 901 performs the staple sorting process in the following manner. The sheet processing apparatus 901 successively receives the sheets P having had images formed on one side or two sides thereof in the apparatus main body 903 of the image forming apparatus 902 by an intermediate tray 906 and at the same time, aligns the width (width-aligns) of the sheets by a width aligning device 907 and makes the sheets into a bundle shape. Thereafter, an end portion stapler unit 908 binds the end portion of the sheet bundle. Lastly, a pair of discharging rollers 909 discharge the sheet bundle onto a sheet stacking portion 904.

In the conventional sheet processing apparatus, however, when the booklet is made, if folding pressure is weak or the sheets are sheets of a material difficult to fold, it has sometimes happened that the open ends of the sheet bundle in the shape of a twice-folded pamphlet somewhat may be opened and the dignity of the sheet bundle may be lowered. Also, when the open ends of the sheet bundle are opened thus, it has sometimes happened that a sheet bundle subsequently discharged enters between the open ends of the preceding sheet bundle and the sheet bundles cannot be successively reliably stacked.

SUMMARY OF THE INVENTION

The present invention has as an object thereof to provide a sheet processing apparatus which almost prevents the open ends of a folded sheet bundle from opening.

The present invention has as an object thereof to provide an image forming apparatus provided with a sheet processing apparatus which almost prevents the open ends of a folded sheet bundle from opening, and improved in image forming efficiency.

In order to achieve the above object, the sheet processing apparatus of the present invention is provided with a curling unit which curls an end portion of a sheet, and a folding device which folds a sheet or a sheet bundle, and the folding device is adapted to fold the sheet or the sheet bundle so that the end portions of the sheet curled by the curling unit may face inwardly.

In order to achieve the above object, the image forming apparatus of the present invention is provided with an image forming portion which forms an image on a sheet, and a sheet processing apparatus which performs a processing on the sheet on which an image has been formed by the image forming portion, and the sheet processing apparatus is the above-described sheet processing apparatus.

In the sheet processing apparatus of the present invention, the folding device is adapted to fold the sheet bundle so that the end portion of the sheets curled by the curling unit may face inwardly and therefore, it becomes difficult for the open ends of the folded sheet bundle to open, and the dignity of the sheet bundle can be enhanced.

In the image forming apparatus of the present invention, even if the sheet processing apparatus continuously discharges sheet bundles, it hardly happens that a succeeding sheet bundle enters between the open ends of a preceding sheet bundle, because it is difficult for the open ends of the preceding sheet bundle to open, and image can be continuously formed on sheets and image forming efficiency can be improved.

DESCRIPTION OF THE PREFERRED EMBODIMENTS

An image forming apparatus and a sheet processing apparatus according to an embodiment of the present invention will hereinafter be described with reference to the drawings.

(Image Forming Apparatus)

Figure 1:
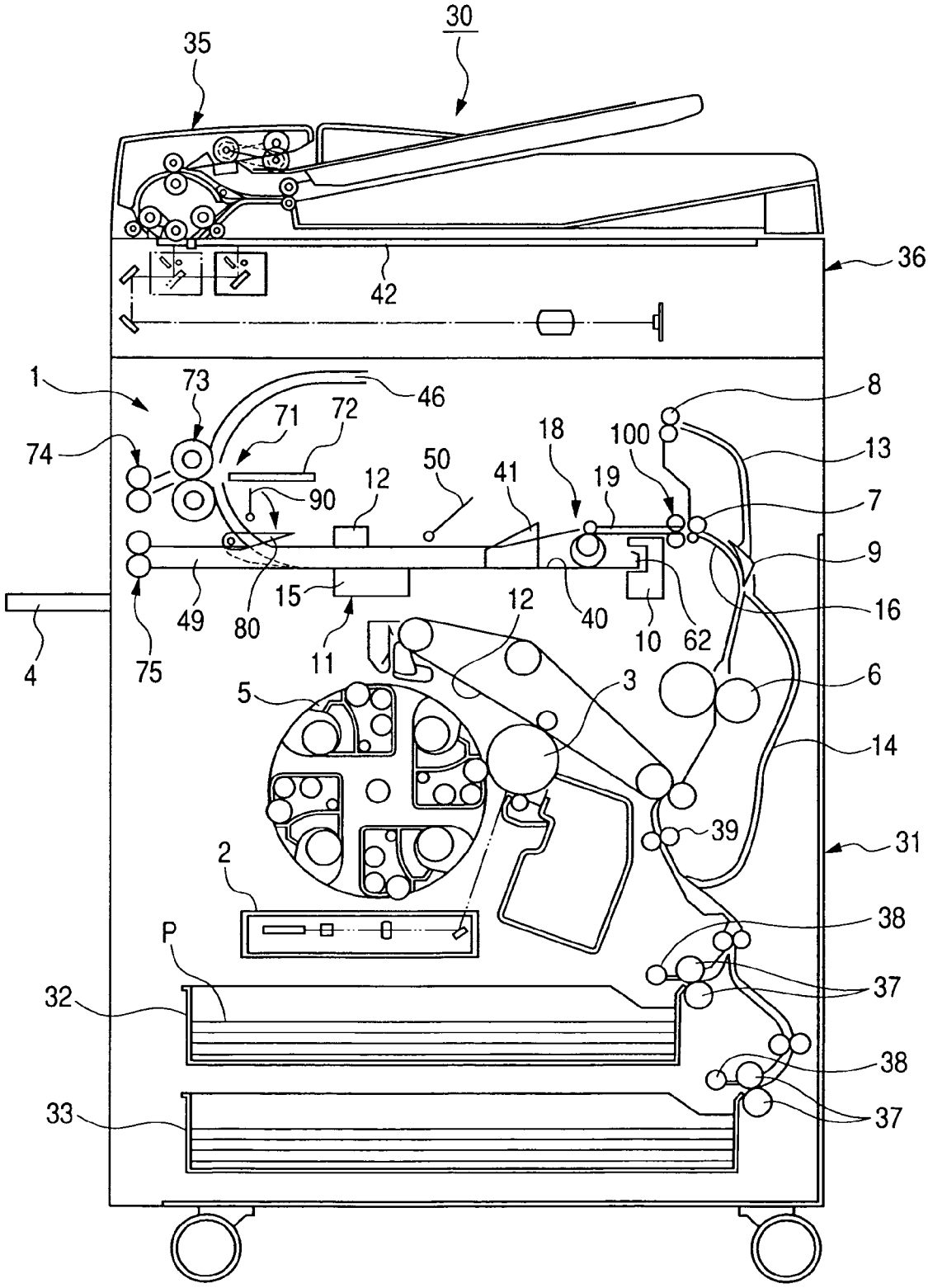
FIG. 1 is a schematic front cross-sectional view of a color copying machine as an image forming apparatus according to an embodiment of the present invention.

A color copying machine as an image forming apparatus will hereinafter be described with reference to FIG. 1. Image forming apparatuses include a copying machine, a printing machine, a laser beam printer and a compound machine of these. The image forming apparatus according to the embodiment of the present invention is a multi-color copying machine, but is not restricted thereto.

The color copying machine 30 has an apparatus main body 31, a sheet processing apparatus 1, an image reading apparatus 36 and an original supplying apparatus 35 in the named order from below. This color copying machine 30 is of a so-called in-body discharge type since sheets are discharged to the sheet processing apparatus 1 between the apparatus main body 31 and the image reading apparatus 36. Also, the sheet processing apparatus 1 may be detachably mountable.

The original supplying apparatus 35 is adapted to automatically supply an original to the image reading apparatus 36. The image reading apparatus 36 as reading means is adapted to read the original supplied by the original supplying apparatus 35, or an original placed on an original plate 42 by a user with the original supplying apparatus 35 being opened rearwardly. The image reading apparatus 36 need not always be provided. Also, even if the image reading apparatus 36 is provided, the original supplying apparatus 35 need not always be provided.

The operation of the color copying machine 30 will now be described. The original supplying apparatus 35 automatically feeds the original to the reading position of the image reading apparatus 36. The image reading apparatus 36 reads the image of the original. A controller (not shown) sends a signal to a laser scanner unit 2 on the basis of image information read by the image reading apparatus 36. The laser scanner unit 2 applies a laser beam to a photosensitive drum 3 constituting an image forming portion and having had its surface uniformly charged. The image information signal the laser scanner unit 2 receives may be an image information signal sent from an external personal computer or the like. Also, when the image reading apparatus 36 is not provided, the laser scanner unit 2 applies the laser beam to the photosensitive drum 3 on the basis of an image signal sent from the outside.

An electrostatic latent image on the photosensitive drum 3 is toner-developed by a developing device 5 and becomes a toner image. The toner image is transferred to a transfer belt 21, and thereafter is transferred to a sheet P such as paper or an OHP sheet.

On the other hand, sheets P are suitably selectively sent out of sheet cassettes 32 and 33 by a pickup roller 38 and are separated one by one by a pair of separating rollers 37, and are fed to a pair of registration rollers 39. Then, the sheet P has its skew feeding corrected by the pair of registration rollers 39, and thereafter is sent to a transferring position in synchronism with the rotation of the photosensitive drum 3 and the transfer belt 21. As the result, the toner image on the transfer belt 21 is transferred to the sheet P.

Thereafter, the sheet P is guided to a pair of fixing rollers 6, and is heated and pressurized by the pair of fixing rollers 6, whereby the toner image thereon is permanently fixed. A fixing upper separation pawl and a fixing lower separation pawl are in contact with respective ones of the pair of fixing rollers 6, and the sheet P is separated from the pair of fixing rollers 6 by these pawls. The thus separated sheet P is sent from the apparatus main body 31 of the color copying machine into the sheet processing apparatus 1 by a pair of first discharging rollers 7.

Also, the separated sheet P, if it is set to two-side print, is guided to a conveying path 13 by a direction switching flapper 9, and has its leading end portion discharged to the outside of the apparatus main body 31 by a pair of second discharging rollers 8. When the trailing end portion of the sheet P passes the direction switching flapper 9, the pair of second discharging rollers 8 are reversely rotated and the sheet P is guided to a conveying path 14 by the direction switching flapper 9. Thereby, the front side and backside of the sheet P are reversed, and the sheet is again sent to the transfer belt 21, and a toner image is transferred to the backside of the sheet P. Thereafter, the sheet P is heated and pressurized by the pair of fixing rollers 6, and has the toner image thereon fixed, and is sent from the apparatus main body 31 into the sheet processing apparatus 1 via a conveying path 16 by the pair of first discharging rollers 7.

(Sheet Processing Apparatus)

The sheet processing apparatus will now be described with reference to FIGS. 1 to 13. The sheet processing apparatus according to the present embodiment is incorporated in the color copying machine, but may be incorporated in a printing machine, a laser beam printer or the like. The sheet processing apparatus according to the present embodiment may not be one incorporated in only the color copying machine.

(Description of the Construction of the Sheet Processing Apparatus)

Figure 9:
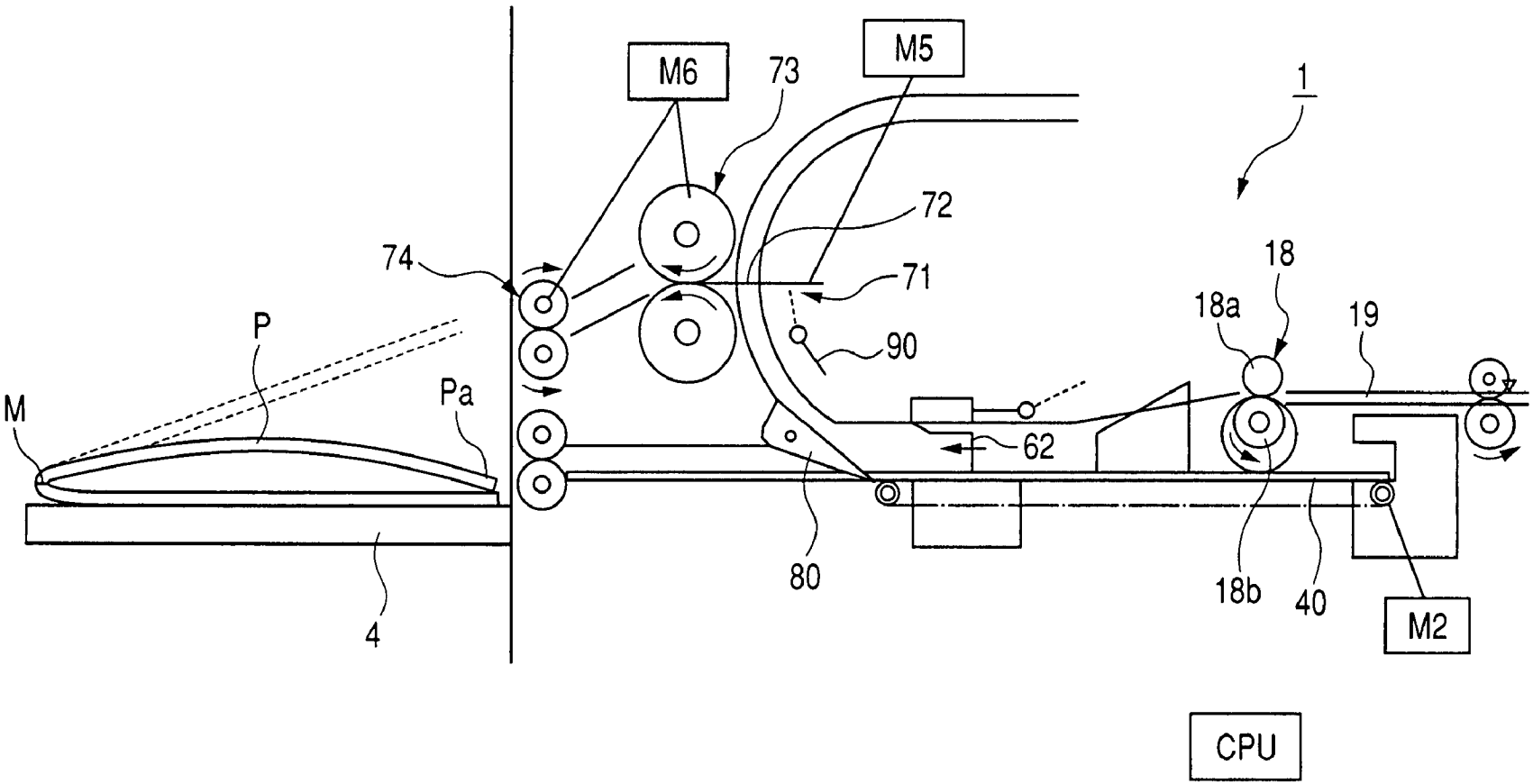
FIG. 9 shows a state in which subsequently to FIG. 8, the sheet bundle has been discharged.

The sheet processing apparatus 1 is provided with a pair of curling rollers 100 as a curling unit which curls the leading end of the sheet in the thickness direction of the sheet, and a folding device 71 which folds a sheet or a sheet bundle curled by the pair of curling rollers 100, and as shown in FIG. 9, the folding device 71 is adapted to fold the sheet or the sheet bundle so that the end portion Pa of the sheets P curled by the pair of curling rollers 100 may face inwardly.

The sheet processing apparatus 1 is adapted to perform the saddle stitching (booklet mode processing) of making the sheets sent from the apparatus main body 31 of the color copying machine 30 into a bundle shape and binding the center and the vicinity of the central portion of the sheet bundle by an intermediate portion stapler (saddle stitching stapler) 11, and then folding the sheet bundle into two to thereby make it into a-booklet shape, the side stitching bookbinding process (stapler sorting process, side stitching mode) of binding the end portion of the sheet bundle by an end portion stapler 10, and the aligning process (sorting process) of not binding the sheet bundle, but only aligning the sheet bundle. The sheet processing apparatus 1 may be adapted to perform only at least the saddle stitching.

A conveying path 19 is adapted to receive the sheet from the pair of first discharging rollers 7. A pair of discharging rollers 18 as a sheet conveying portion is adapted to discharge the sheet from the conveying path 19 onto a processing tray 40 as a stacking portion.

Figure 3:
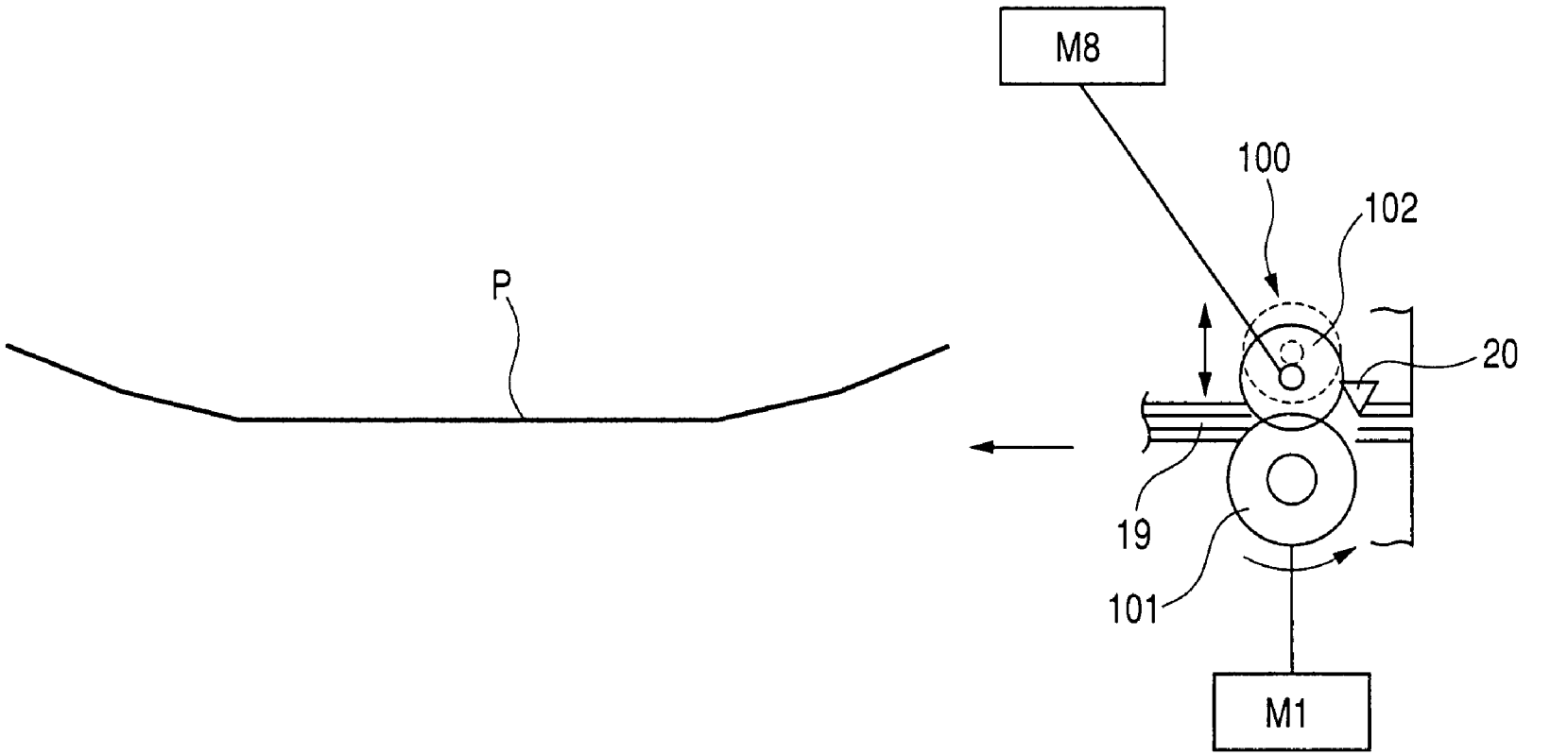
FIG. 3 is an enlarged view of a pair of curling rollers in the sheet processing apparatus shown in FIG. 2.

The pair of curling rollers 100 are provided upstream of the pair of discharging rollers 18 in the conveying path 19. As shown in FIG. 3, the pair of curling rollers 100 are comprised of a nip roller 101 formed by an elastic member (urethane foam roller) of low hardness rotated by a nip roller rotating motor M1, and a pressure roller 102 of high hardness (metal) being in contact with and driven to rotate by the nip roller 101. The pressure roller 102 is adapted to be moved between a pressurizing position indicated by the solid line and a retracted position indicated by the broken line by a pressure roller moving motor M8 so as to be moved toward and away from the nip roller 101. The pressure roller 102 more or less squeezes the nip roller 101 and is contact with the nip roller 101. Therefore, curl (upper curl) in the same direction as the shape of the nip (upward curve) is imparted to the sheet which has passed the pair of curling rollers 100 in which the pressure roller 102 is in pressure contact with the nip roller 101. The direction of the curl is the same direction as the direction of curve of a curved path 46 which will be described later. The pressure force of the pressure roller 102 is set so that all of the sheets being conveyed may assume curl of a curvature larger at minimum than the curvature of the curved path 46.

The pair of discharging rollers 18 as a sheet conveying portion is comprised of a drive roller 18*a* and a driven roller 18*b* being in contact with and driven to rotate by this drive roller 18*a*. The drive roller 18*a* is adapted to be rotated by a nip roller rotating motor M1. Also, a return belt 60 is nipped by the nip between the pair of discharging rollers 18. The return belt 60 is also adapted to be driven to rotate in a counter-clockwise direction by the drive roller 18*a*. A discharged sheet sensor 20 as a sheet detecting sensor is disposed near the upstream side of the pair of curling rollers 100. The discharged sheet sensor 20 is adapted to detect the sheet passing the conveying path 19, and the pressure roller moving motor M8 is controlled by a controlling portion which will be described later so as to be driven on the basis of the result of detection by the discharged sheet sensor 20 to thereby move the pressure roller 102 toward and away from the nip roller 101.

The processing tray 40 is formed into a flat shape and is horizontally disposed. A trailing end stopper 62 which provides the upstream side end portion (the right end portion, i.e., the trailing end portion, as viewed in FIG. 2) of the sheets on the processing tray 40 with respect to the conveying direction of the sheets stands by on one end portion of the processing tray 40.

Figure 2:
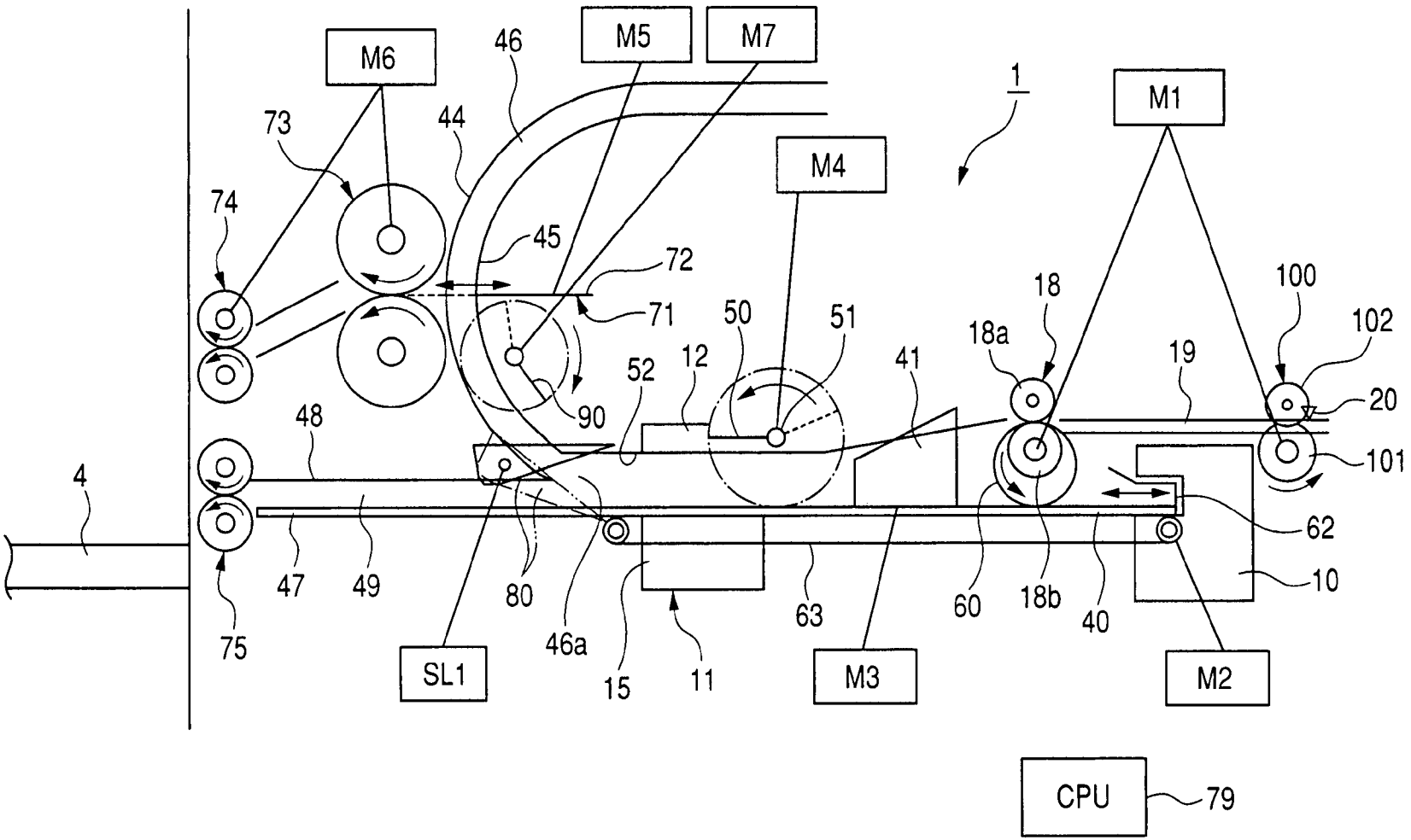
FIG. 2 is a schematic front cross-sectional view of a sheet processing apparatus in an embodiment of the present invention.

Accordingly, the sheets stacked on the processing tray 40 are adapted to be subjected to the returning force of the return belt 60 and to have their trailing end abutted against the trailing end stopper 62 and aligned thereby. The trailing end stopper 62 as a sheet bundle conveying portion is provided on a belt 63. The belt 63 is adapted to be circulated by a belt motor M2. The trailing end stopper 62, as shown in FIG. 2, has the right end portion of the return belt 60 as its home position.

An end portion stapler 10 is disposed near the home position of the trailing end stopper 62. The end portion stapler 10 is adapted to needle-bind the trailing end of the sheet bundle.

A pair of aligning plates 41 are adapted to align (width-align) the end portion, which is along the sheet conveying direction, of the sheet bundle on the processing tray 40. The pair of aligning plates 41 are adapted to be moved in the width direction of the sheet by a rack gear and a pinion gear (not shown) and a pinion motor M3 for rotating the pinion gear. A return paddle 50 is adapted to be rotated in the direction indicated by the arrow (counter-clockwise direction) about a supporting shaft 51 to thereby send the sheet discharged from the pair of discharging rollers 18 to the trailing end stopper 62 side. The return paddle 50 has its surface formed by an elastic member of a low coefficient of friction, and is adapted to make the sheet abut against the trailing end stopper 62, and thereafter be rotated while sliding on the sheet. Also, the stopped position of the return paddle 50 is retracted to above an upper guide 52 which will be described later so as not to hinder the conveyance of the sheet (the position indicated by the solid line in FIG. 2). The return paddle 50 is adapted to be rotated by a paddle motor M4.

Two intermediate portion staplers 11 are disposed downstream of the return paddle 50 in the width direction of the sheet. These intermediate portion staplers 11 are constituted by an anvil 12 and a driver 15. The upper guide 52, together with the processing tray 40, is adapted to guide the sheet to between the anvil 12 and the driver 15. The sheet receiving portion of the upper guide 52 is inclined into a trumpet shape, and the vicinity of the intermediate portion stapler 11 is a surface parallel to the horizontally disposed processing tray 40. The intermediate portion staplers 11 are adapted to needle-bind the intermediate portion of the sheet bundle during the "booklet mode".

A curved path 46 as a curved guide path and a horizontal path 49 as a straight guide path are disposed downstream of the intermediate portion staplers 11. The curved path 46 and the horizontal path 49 are adapted to be selected by a flapper 80. The flapper 80 is adapted to selectively tilt the paths 46 and 49 by a solid SL1. The curved path 46 upwardly branches off from the horizontal path 49 with a branch-off portion 46*a* as a boundary and is curved, and is comprised of an inner guide 45 and an outer guide 44. The horizontal path 49 is extended straight from the processing tray 40, and is comprised of an upper guide 48 and a lower guide 47. Also, the spacing between the pair of fixing rollers 6 in the apparatus main body 31 of the color copying machine 30 shown in FIG. 1 and the branch-off portion 46*a* shown in FIG. 2 is set so as to be longer than the longest sheet to be processed by the present apparatus. Conveying rollers (including the pair of first discharging rollers 7) downstream of the pair of fixing rollers 6 are adapted to convey the sheet at a speed synchronized with the pair of discharging rollers 18.

A paddle 90 is disposed on the curved path 46 downstream of the branch-off portion 46*a*. The paddle 90, like the return paddle 50, has its surface formed by an elastic member of a low coefficient of friction, and the conveying force thereof is set to a level lower than that of the pair of discharging rollers 18. The paddle 90 is adapted to receive the rotating force of a paddle motor M7 and be rotated in the direction indicated by the arrow (clockwise direction). The paddle 90 is usually retracted to the inside of the curvature of the inner guide 45 so as not to hinder the sheet moved in the curved path 46.

A thrusting plate 72 is disposed inside the curvature of the curved path 46. The thrusting plate 72 is adapted to be reciprocally moved in the directions indicated by the arrows (solid line and broken line) by a thrusting plate driving motor M5 and a transmitting mechanism (e.g. a link mechanism), not shown. A stand-by position (solid line position) is inside the curvature of the curved path 46. A thrusting position (broken line position) is a position extending through the curved path 46. Through-holes are formed at locations in the inner guide 45 and the outer guide 44 which correspond to the thrusting plate 72 so as not to hinder the movement of the thrusting plate 72.

A pair of folding rollers 73 are disposed so that the nip therebetween may be opposed to the thrusting plate 72, and are adapted to be rotated in the direction indicated by the arrow and fold the sheets into two when the sheets in the curved path 46 are thrust by the thrusting plate 72. The folded sheets are stacked on the stacking tray 4 via a pair of booklet discharging rollers 74. The pair of folding rollers 73 and the pair of saddle booklet discharging rollers 74 are adapted to be rotated by a folding motor M6. The thrusting plate 72, the pair of folding rollers 73, the thrusting plate driving motor M5 and the folding motor M6 together constitute a folding device 71.

Also, a pair of bundle discharging rollers 75 for discharging the sheets in the horizontal path 49 to the stacking tray 4 are provided on the downstream end portion of the horizontal path 49. The pair of bundle discharging rollers 75 are adapted to be rotated by a nip roller rotating motor M1. The above-described motors M1 to M8, the solenoid SL1 and the discharged sheet sensor 20 are connected to a CPU 79 as a controlling portion, and the sheet conveyance, the movement of the pressure roller 102 toward and away from the nip roller 101 and the folding processing are adapted to be controlled by the CPU 79. While in the present embodiment, description is made of a construction in which the CPU 79 is provided in the sheet processing apparatus 1, design may be made such that the sheet processing apparatus 1 is controlled by a controlling portion on the side of the color copying machine 30 as an image forming apparatus.

(Description of the Operation in the "Booklet Mode (Saddle Stitch Bookbinding Processing)")

Figure 4:
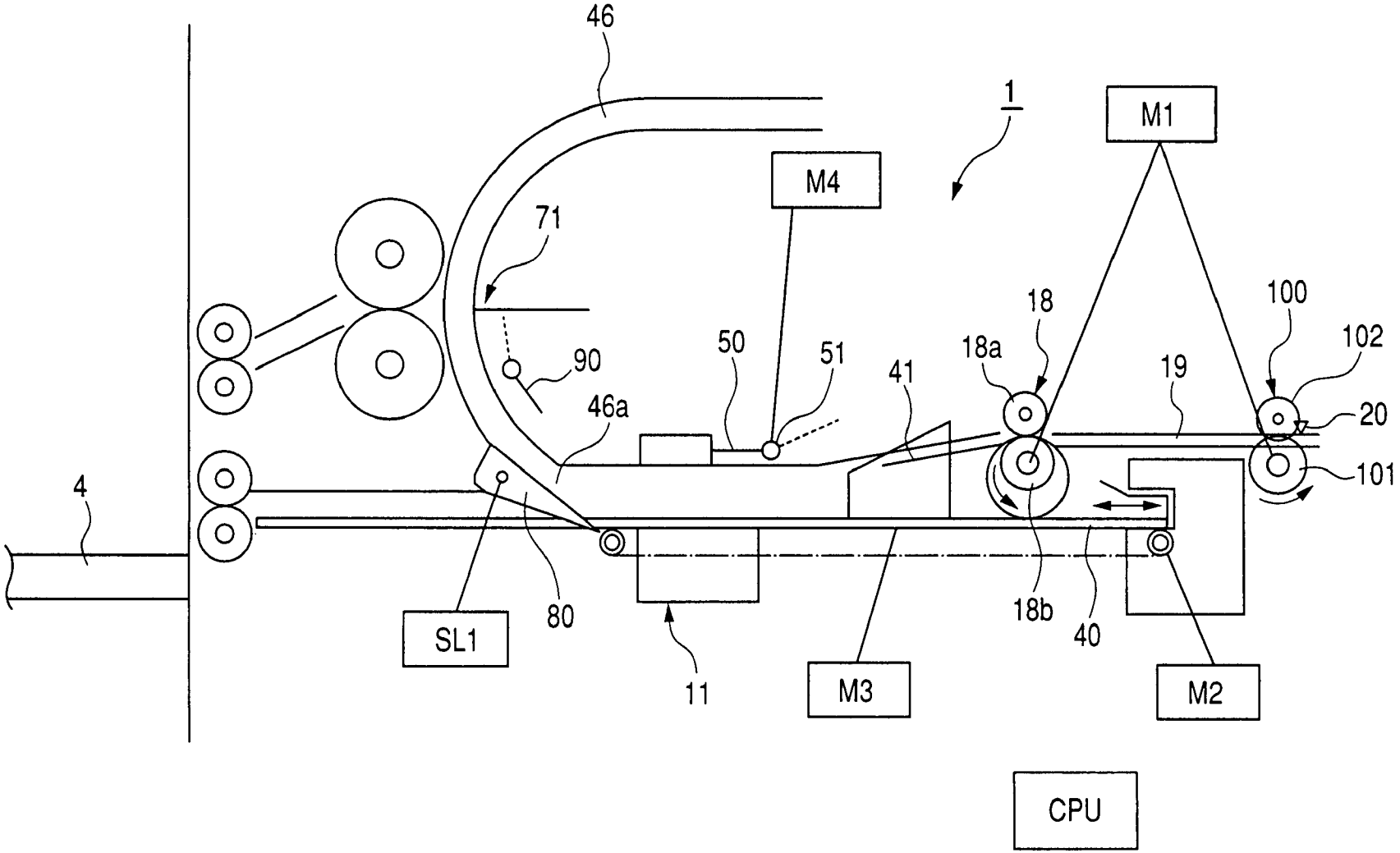
FIG. 4 shows a state in which in a booklet mode (saddle stitch bookbinding processing), a sheet has been sent from the apparatus main body of the color copying machine.

When the booklet mode is designated, the pressure roller 102 of the pair of curling rollers 100 is moved to its pressurizing position, as shown in FIG. 4. That is, the pressure roller 102 is brought into pressure contact with the nip roller 101 by the nip roller rotating motor M1. Then, the flapper 80 is moved to its shown position by the solenoid SL1 and selects the curved path 46.

Figure 5:
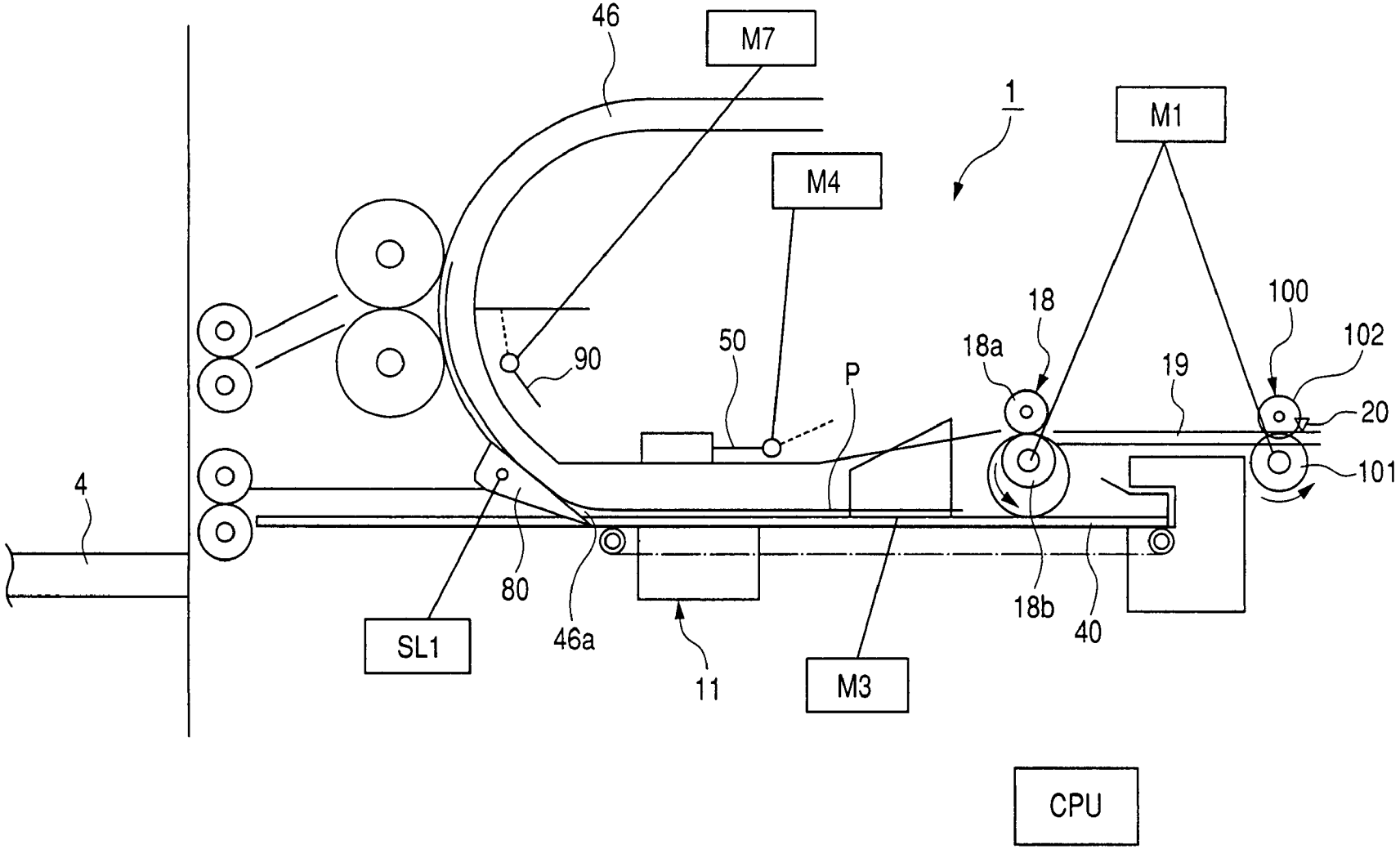
FIG. 5 shows a state in which subsequently to FIG. 4, the sheet has been stacked on a processing tray.

The sheet P discharged from the apparatus main body 31 of the color copying machine 30 has its leading end detected by the discharged sheet sensor 20, and has an upper curl imparted thereto by the pair of curling rollers 100 on the basis of the result of detection by the sensor 20 and is conveyed. When the conveyance length of the sheet conveyed is defined as L1 and the distance between the pair of discharging rollers 18 and the branch-off portion 46*a* as the boundary of the curved path 46 is defined as L2, when the sheet is conveyed by an amount corresponding to the length of (L1-L2) by the pair of curling rollers 100, the pressure roller 102 is moved to its retracted position. When the sheet has been discharged onto the processing tray 40 in this manner, curl in the same direction as the curved path 46 is imparted to the leading end portion of the sheet entering the curved path 46 subsequent to the branch-off portion 46*a*, by an amount corresponding to the length of (L1-L2). As shown in FIG. 5, thereafter, the sheet is continuedly conveyed by the pair of discharging rollers 18 and is discharged onto the processing tray 40. The sheet has an appropriate curl imparted upwardly to its leading end and therefore, smoothly slides on the processing tray 40 and is discharged to the processing tray 40. At that time, the leading end of the sheet goes into the curved path 46. Since, however, a curl is imparted to the leading end of the sheet, the sheet hardly receives resistance from the curved path 46 and is stably conveyed and discharged with its load mitigated.

The conveyance length L1 of the sheet conveyed differs depending on the size of the sheet conveyed. In contrast, the distance L2 between the pair of discharging rollers 18 and the branch-off portion 46*a* is definite. Therefore, the curl imparted length, i.e., the length (L1-L2) going into the curved path 46, differs depending on the length size of the sheet. The length (L1-L2) is determined by the timing at which the pressure roller 102 is retracted. Since as described above, the curl imparted length can be changed by the length size of the sheet, the sheet processing apparatus 1 according to the present embodiment can stably perform the sheet conveying and discharging operation irrespective of the length size of the sheet.

Also, this curl may be formed only in thick paper (basis weight of about 105 g/m$^2$ to about 250 g/m$^2$) difficult to turn the curved path 46 and receiving resistance on the curved path 46. By limiting the range of the basis weight of the sheet as described above, it is possible to enhance the accuracy of the amount of curl imparted to the sheet. If plain paper (basis weight of about 64 g/m$^2$ to about 90 g/m$^2$) is conveyed when thick paper is being conveyed, the curling roller 102 is retracted and the sheet is conveyed and discharged from the conveying path 19 by only the pair of discharging rollers 18. The setting of the basis weight of the sheet is inputted from the operating portion (not shown) of the color copying machine 30, but a sheet thickness detecting sensor may be provided in the sheet conveying path so that control may be effected on the basis of the result of detection thereby.

Figure 6:
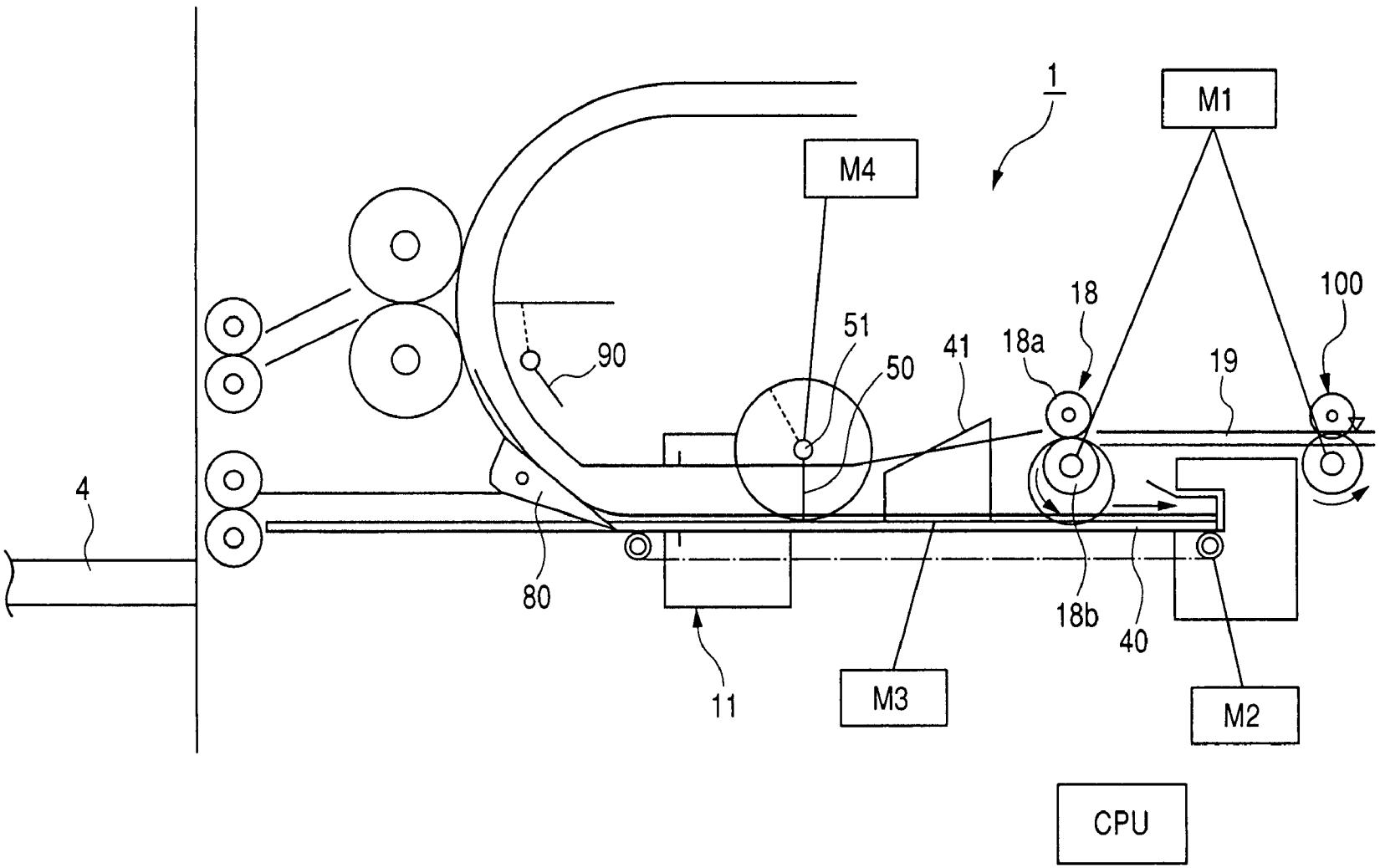
FIG. 6 shows a state in which subsequently to FIG. 5, the sheet has contacted with a trailing end stopper.

As shown in FIG. 6, the sheet P discharged onto the processing tray 40 starts to be moved in the direction indicated by the arrow with the rotation of the return paddle 50 so far stopped, and is abutted against the trailing end stopper 62 and has its trailing end aligned while also receiving the conveying force of the return belt 60. Subsequently, the width aligning of the sheet is also effected by the nipping operation of the pair of aligning plates 41. At this time, curling to the sheet is effected to only the leading end portion going into the curved path 46 and therefore, such problems as the faulty return to the trailing end stopper 62 and the buckling when the sheet is abutted against the trailing end stopper 62 which are liable to arise when the trailing end portion is curled do not arise.

The above-described operation is repeated until a predetermined number of sheets are stacked on the processing tray 40.

Figure 7:
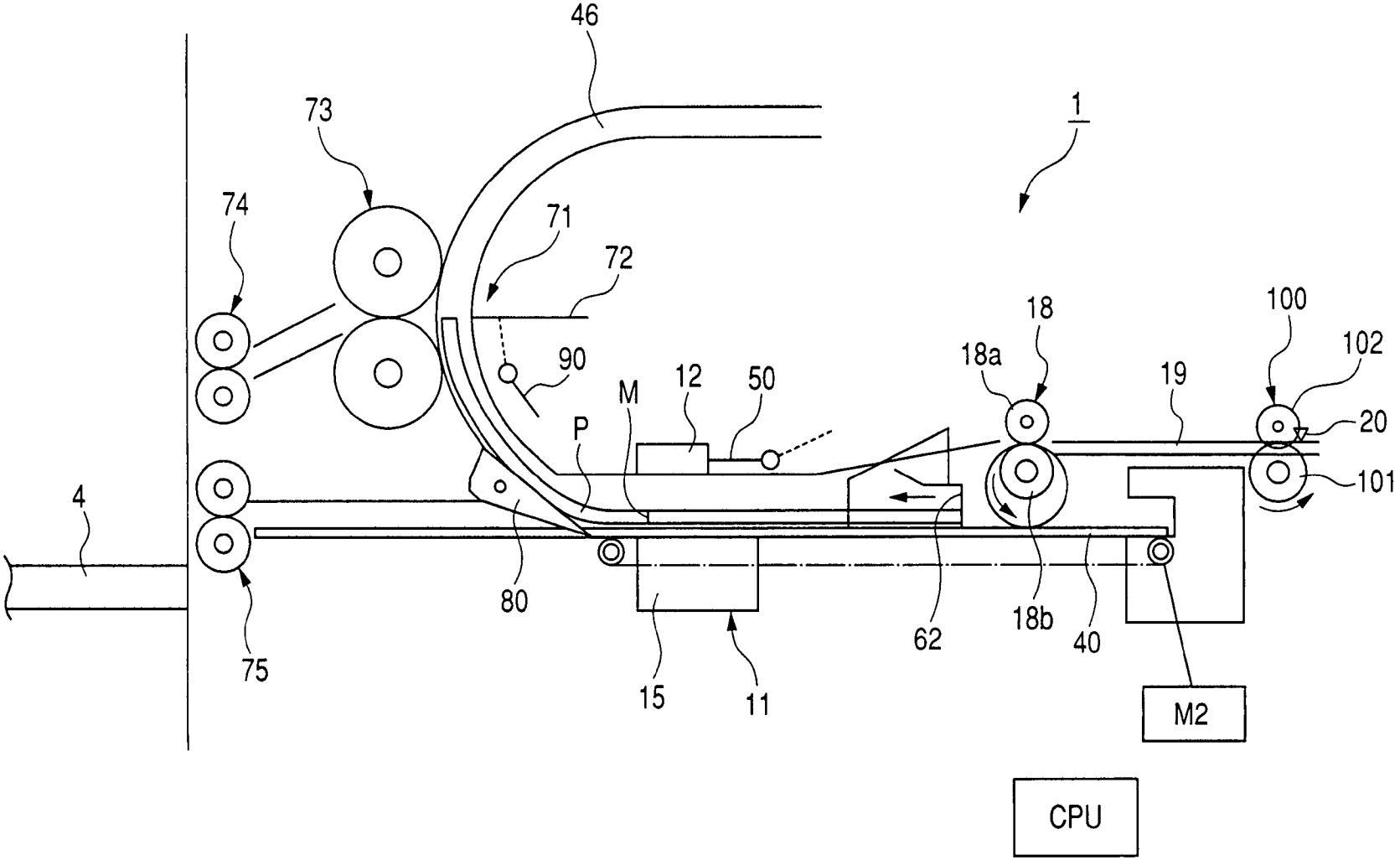
FIG. 7 shows a state in which subsequently to FIG. 6, a sheet bundle has been bound, and thereafter is conveyed to a curved path.

Next, as shown in FIG. 7, the trailing end stopper 62 is moved in the direction indicated by the arrow, and conveys the sheet bundle stacked on the processing tray 40 so that the center of the sheet bundle with respect to the conveying direction may be opposed to the binding position of the intermediate portion stapler 11. The intermediate portion stapler 11 performs the needle-binding (stapling) of the sheet bundle. In the meantime, the trailing end stopper 62 is at a halt and holds the trailing end of the sheet bundle. The bound location of the sheet bundle is generally the lengthwise center of the sheet bundle, but need not always be the center. The portion indicated by the reference character M is the bound portion.

Figure 8:
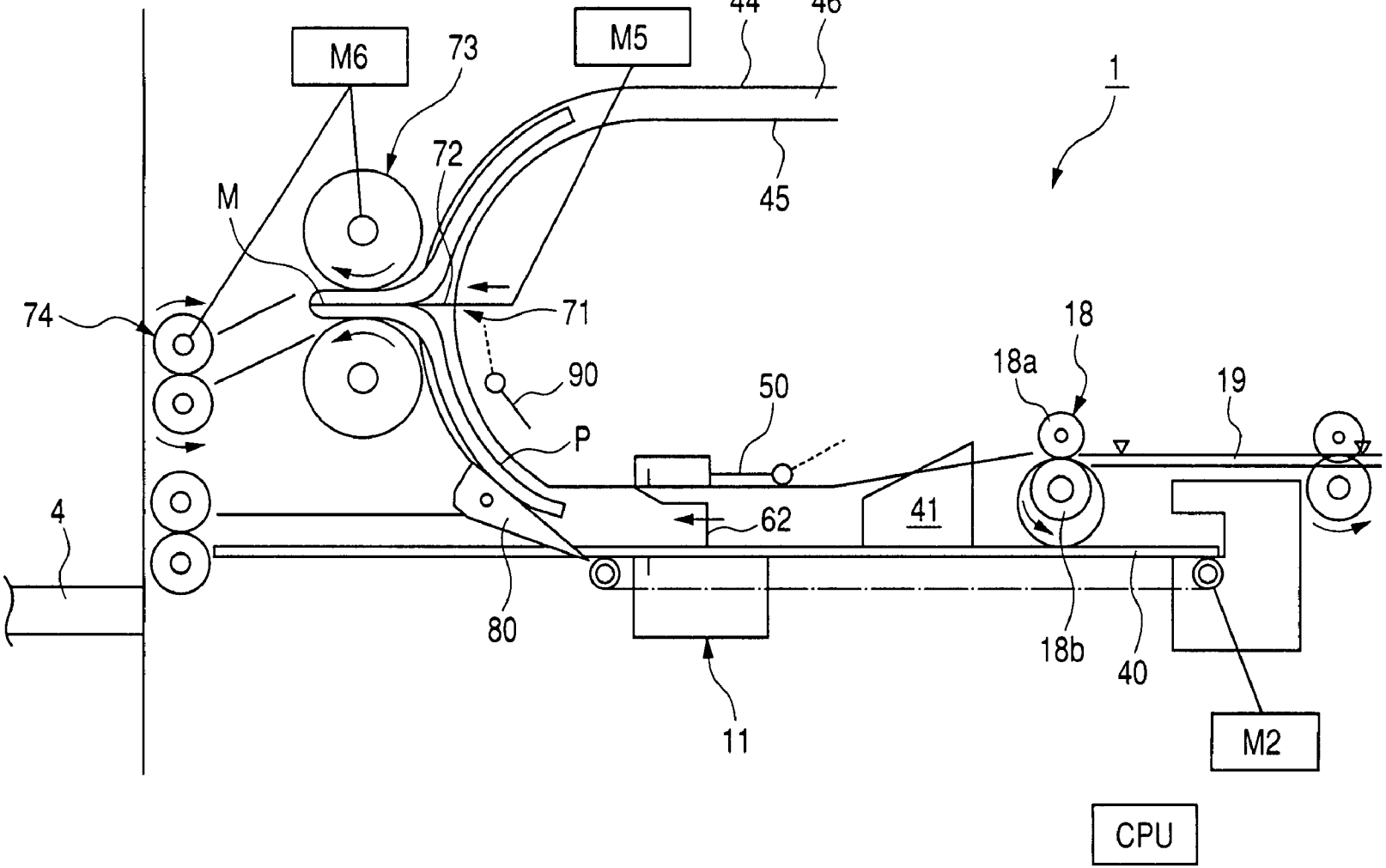
FIG. 8 shows a state when subsequently to FIG. 7, the sheet bundle is being folded.

Then, the trailing end stopper 62 is again moved to the downstream side with respect to the sheet conveying direction, and conveys the sheet bundle so that the center of the sheet bundle with respect to the conveying direction may arrive at the nip between the pair of folding rollers 73, and is stopped. Thereafter, as shown in FIG. 8, the thrusting plate 72 which has so far been standing by starts the operation of thrusting the sheet bundle. Again during this time, the trailing end stopper 62 is at a halt and holds the trailing end of the sheet bundle. With the start of the movement of the thrusting plate 72, the pair of folding rollers 73 also start to be rotated. By the movement of the thrusting plate 72, the center of the bundle with respect to the conveying direction, i.e., the bound location, is pushed into the nip between the pair of folding rollers 73. Then, the sheet bundle is conveyed by the pair of folding rollers 73 and the pair of booklet discharging rollers 74 while being folded into two, and is stacked on the stacking tray 4, as shown in FIG. 9.

The direction of the curl of the leading end of the sheets and the direction of the curvature of the curved path 46 are upward and the folding device 71 folds the sheet bundle so that the curled portion of the leading end of the sheets may face inwardly and therefore, the folded sheet bundle stacked on the stacking tray 4 is such that the end portion Pa thereof having had a curl imparted thereto by the curling roller 100 faces inwardly. Moreover, this sheet bundle is formed into a booklet shape, and is stacked on the processing tray 40 with the side thereof having the end portion Pa having had a curl imparted thereto overlying and the side thereof having had no curl imparted thereto underlying and therefore, it is difficult for the end portions thereof to open on the stacking tray 4.

Accordingly, the dignity of the sheet bundle can be improved. Also, the succeeding sheet bundle, when discharged from the pair of booklet discharging rollers 74, is not caught by the end portion of the preceding sheet bundle or does not enter the preceding sheet bundle, and is readily stacked on the preceding sheet bundle. Further, it is difficult for the end portions of the sheet bundle made into a booklet shape to open and therefore, the thickness of that sheet bundle is small as compared with that of a sheet bundle not subjected to the curling processing indicated by the broken line in FIG. 9. Therefore, as compared with sheet bundles having had no curl imparted thereto, more sheet bundles having had a curl imparted thereto can be stacked on the stacking tray 4.

In the sheet processing apparatus 1 according to the present embodiment, the direction of the curvature of the curved path 46 is upward, but may be downward. In this case, it is necessary for the leading end of the sheets to be downwardly curled, and when the sheet bundle has been stacked on the stacking tray 4, the curled portion thereof underlies. However, it still holds true that the effects that it is difficult for the end portions of the sheet bundle to open, that the succeeding sheet bundle is readily stacked on the preceding sheet bundle, and that the thickness of the sheet bundle has become small are achieved.

Also, in the sheet processing apparatus 1 according to the present embodiment, there is a case where the radius of curvature of the curved path 46 is large, or a case where depending on the rigidity of the sheets, the sheet bundle can be smoothly conveyed on the portion of the curved path 46 without the leading end of the sheets being curved. In such a case, it is for preventing the sheet bundle from opening that the sheets are curled, and one or both of the leading end and trailing end of the sheets can be curled. That is, at least one of the leading end and trailing end of the sheets can be curled. Also, the sheet bundle is bound at its center by the intermediate portion stapler 11, but the location to be bound is not restricted to the center. Also, the sheet bundle may be folded by the folding device 71 without being bound and be discharged onto the stacking tray 4. Even if the number of the sheets to be performed a process is one, the effects of the present invention are achieved.

Further, the sheet processing apparatus 1 according to the present embodiment is provided with the folding device 71 in the vertical area of the curved path 46 and is therefore formed compactly.

(Description of the Operation in the "Side Stitching Mode (Staple Sorting Process)")

Figure 10:
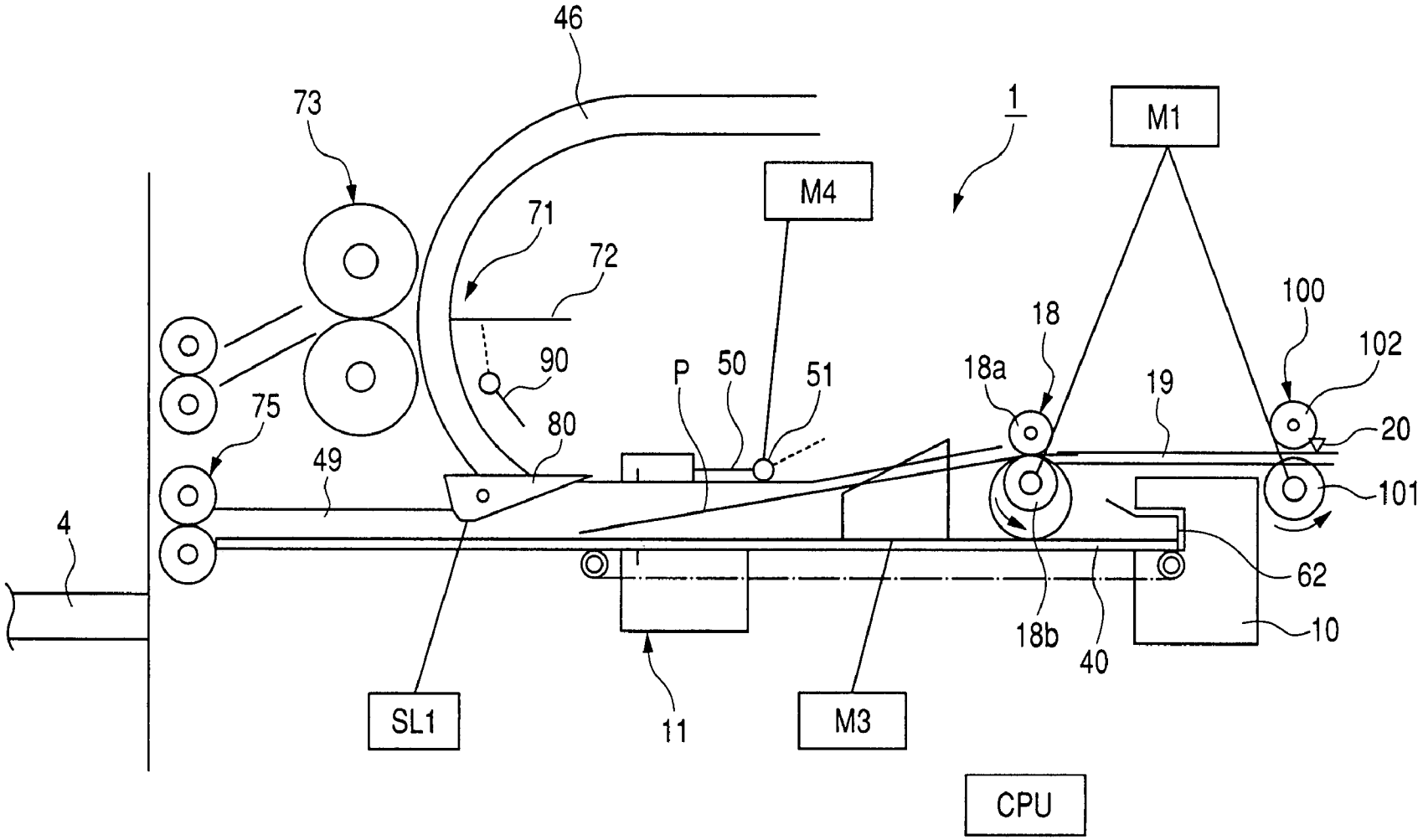
FIG. 10 shows a state in which in a side stitching mode (staple sorting process), a sheet has been sent in from the apparatus main body of the color copying machine.
Figure 11:
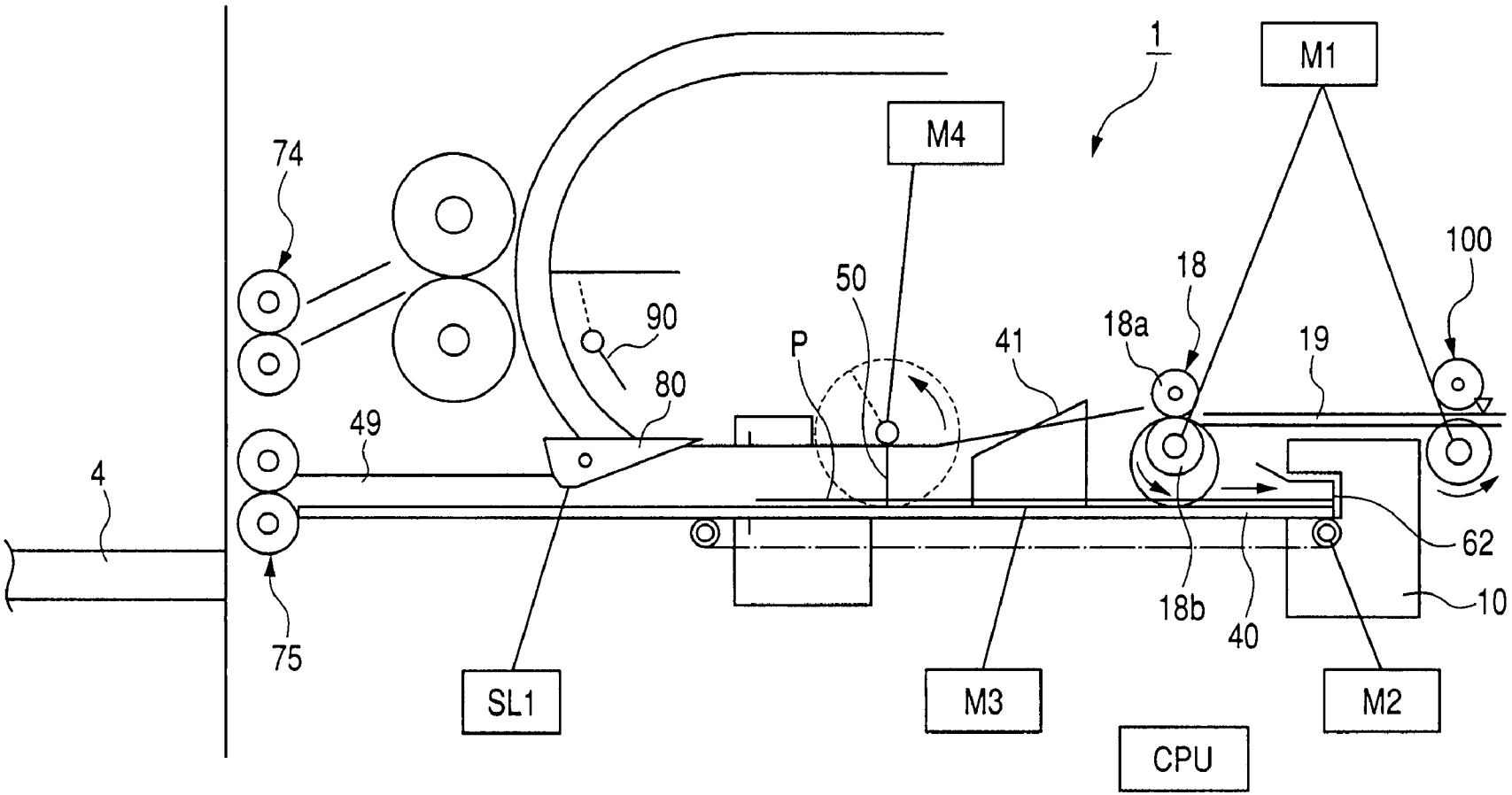
FIG. 11 shows a state in which subsequently to FIG. 10, the sheet has contacted with the trailing end stopper and a sheet bundle has been bound.

When the side stitching mode is designated, as shown in FIG. 10, the pressure roller 102 of the pair of curling rollers 100 is moved to its retracted position, and the flapper 80 is separated from the processing tray 40 and selects the horizontal path 49. The sheet P discharged from the apparatus main body 31 of the color copying machine 30 (see FIG. 1) has its leading end detected by the sensor 20 and passes the conveying path 19, and is conveyed by only the pair of discharging rollers 18 and is discharged onto the processing tray 40. As shown in FIG. 11, the sheet P discharged onto the processing tray 40 starts to be moved in the direction indicated by the arrow with the rotation of the return paddle 50 which has so far been at a halt, and is abutted against the trailing end stopper 62 while receiving the conveying force of the return belt 60. Thereby, the trailing end of the sheet is aligned. Subsequently, the pair of aligning plates 41 nips the sheet therebetween and width-aligns it.

The above-described operation is repeated until a predetermined number of sheets are stacked on the processing tray 40.

Figure 12:
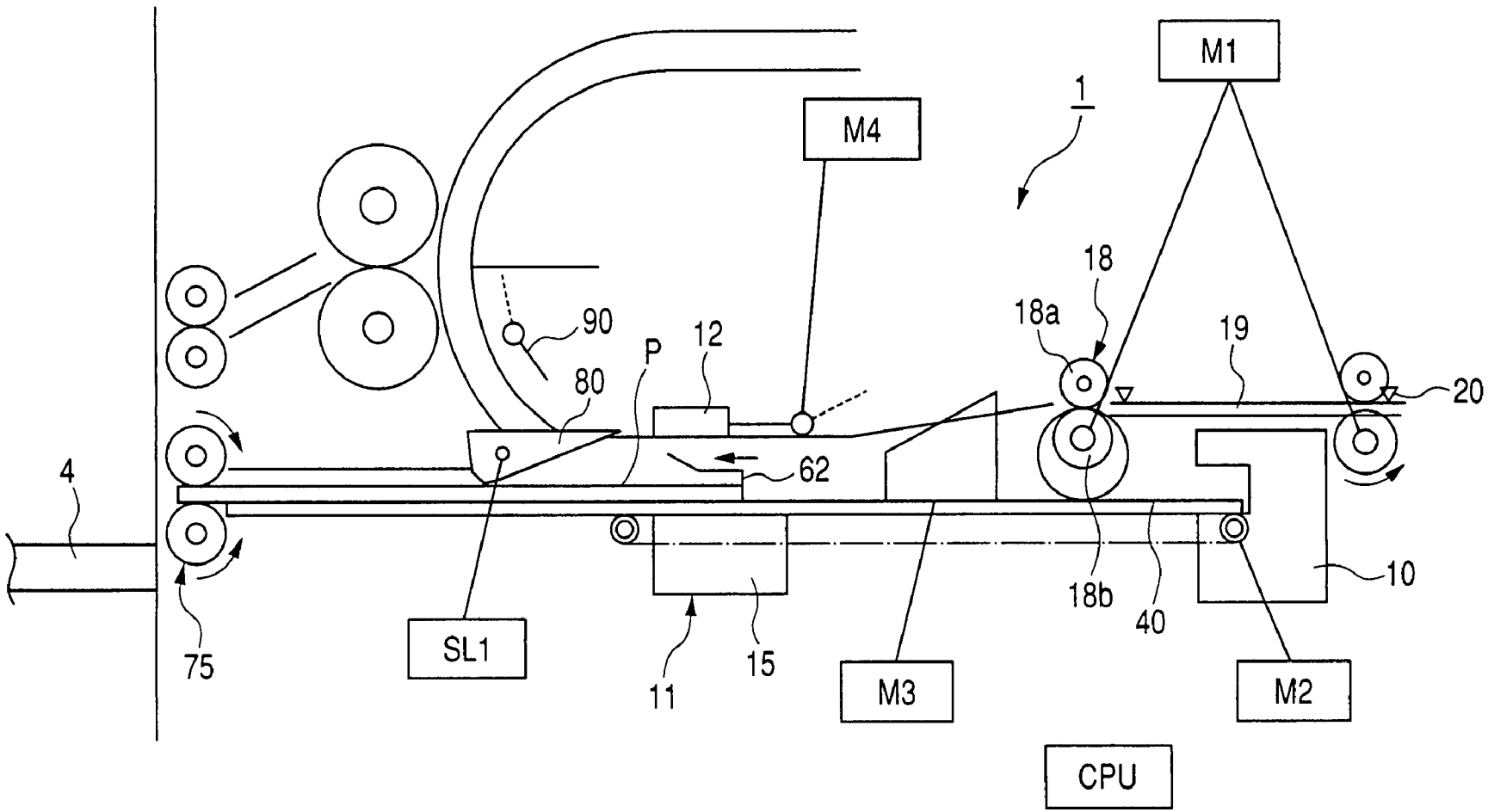
FIG. 12 shows a state in which subsequently to FIG. 11, the sheet bundle has begun to be discharged.
Figure 13:
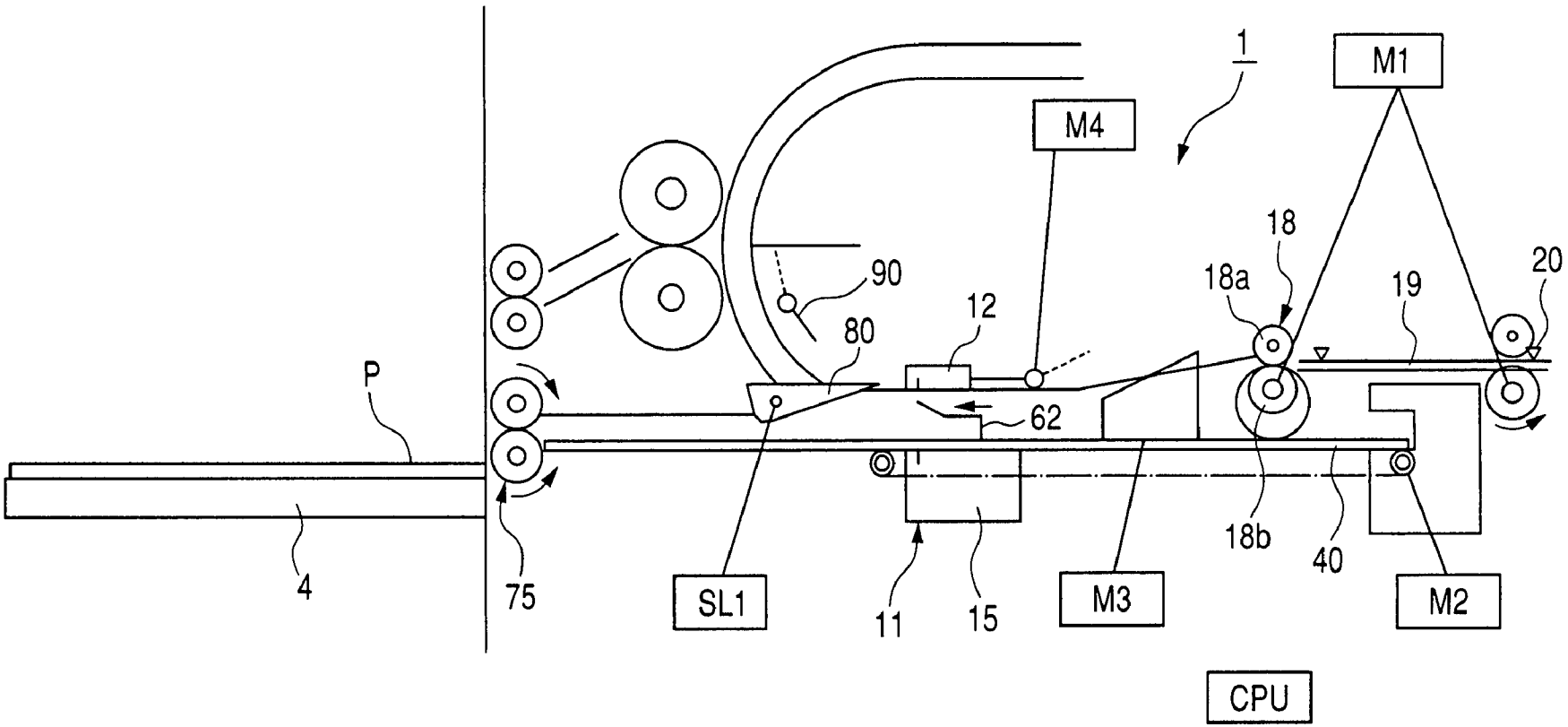
FIG. 13 shows a state in which subsequently to FIG. 12, the sheet bundle has been discharged.
Figure 14:
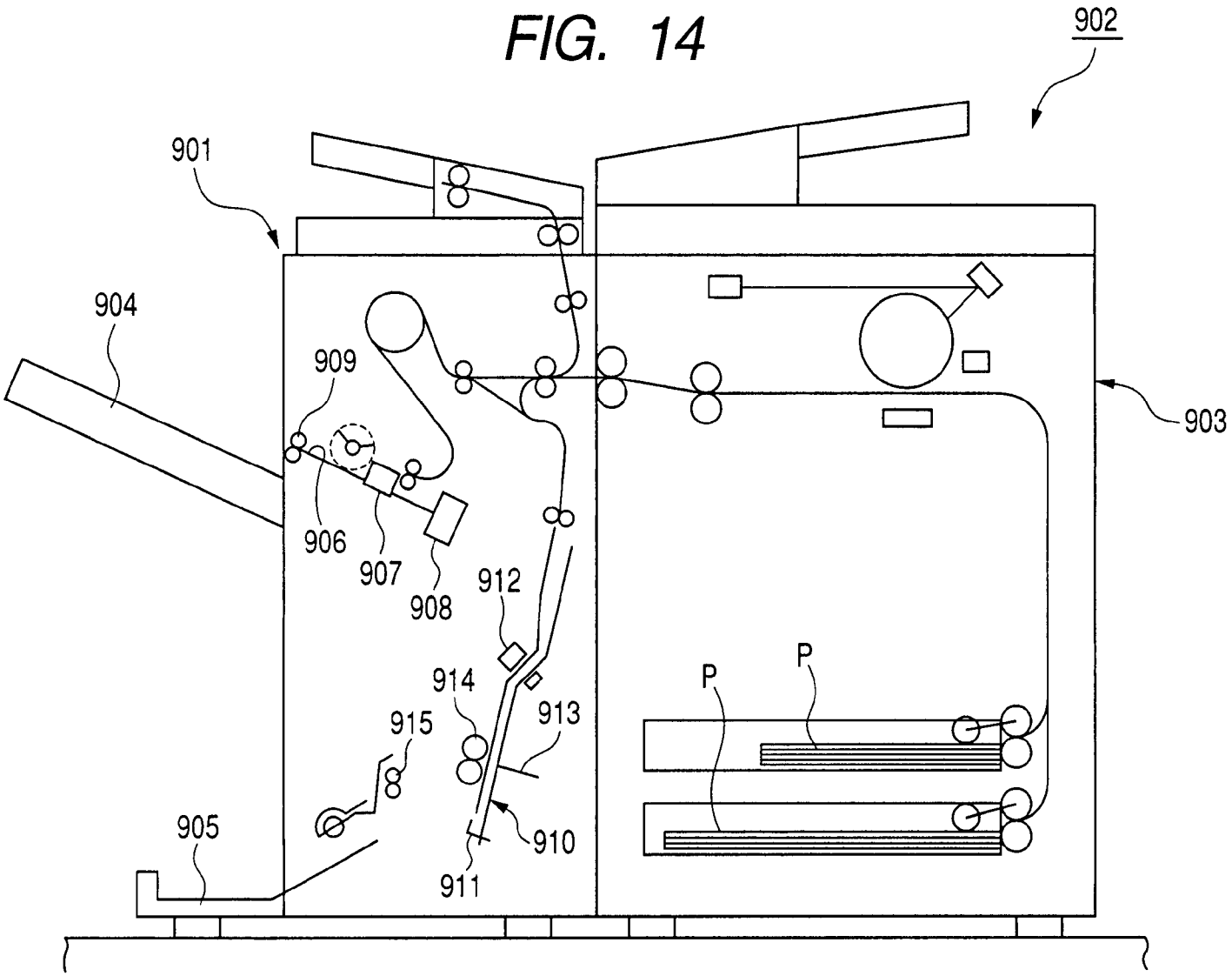
FIG. 14 is a schematic front cross-sectional view of a conventional image forming apparatus.

The aligned sheet bundle is needle-bound at its end portion by the end portion stapler 10. Thereafter, the sheet bundle, as shown in FIG. 12, is moved in the direction indicated by the arrow by the trailing end stopper 62. Then, as shown in FIG. 13, the sheet bundle is delivered to the pair of bundle discharging rollers 75 being rotated with the pair of discharging rollers 18 by the nip roller rotating motor M1, and is stacked on the stacking tray 4. In this manner, there is formed a booklet with the end portion of the sheet bundle needle-bound.

The aligning process (sorting process) is a processing which, in the staple sorting process, does not perform the operation of binding the end portion of the sheet bundle by the end portion stapler 10.

This application claims priority from Japanese Patent Application No. 2004-211807 filed on Jul. 20, 2004 and Japanese Patent Application No. 2005-197628 filed on Jul. 6, 2005, which are hereby incorporated by reference herein.

What is claimed is:

1. A sheet processing apparatus comprising:

a curling unit which curls an end portion of a sheet;

a stacking portion on which the sheet curled by said curling unit is stacked;

a folding device which is disposed downstream of said curling unit and folds a sheet or a sheet bundle curled by said curling unit ;

a sheet bundle conveying portion which conveys the curled sheet or the curled sheet bundle stacked on said sacking portion to said folding device; and a curved guide path which guides the sheet or the sheet bundle conveyed by said sheet bundle conveying portion, wherein said folding device is disposed in said curved guide path, and said curling unit curls the end portion of said sheet in the same direction as a direction of curvature of said curved guide path, and wherein said folding device folds the curled sheet or the curled sheet bundle so that the end portion of the sheet curled by said curling unit may face inwardly.

2. A sheet processing apparatus according to claim 1, wherein the end portion of the sheet curled by said curling unit is at least one of the leading end and trailing end of the sheet.

3. A sheet processing apparatus according to claim 1, wherein said curling unit has a pair of rollers movable toward and away from each other, and wherein said sheet processing apparatus further comprising:

a sheet detecting sensor which detects the sheet conveying to said curling unit; and a controller which controls a timing of movement of said pair of rollers toward and away from each other on the basis of a result of detection by said sheet detecting sensor.

4. A sheet processing apparatus according to claim 1, wherein said curved guide path is upwardly curved.

5. A sheet processing apparatus according to claim 1, further comprising:

a straight guide path which branches off upstream of said curved guide path with respect to a sheet conveying direction, and straight guides the sheet or the sheet bundle conveyed by said sheet bundle conveying portion, wherein said curling unit curls the end portion of the sheet when the sheet or the sheet bundle is guided by said curved guide path.

6. A sheet processing apparatus according to claim 1, further comprising:

a sheet conveying portion which conveys the sheet curled by said curling unit to said stacking portion, wherein a length of a curled portion of the sheet imparted by said curling unit is set to a length obtained by subtracting a length between said sheet conveying portion and said curved guide path from a full length of the sheet.

7. A sheet processing apparatus according to claim 1, further comprising:

a stapler which binds the sheet bundle, wherein said folding device folds a portion of the sheet bundle which has been bound by said stapler.

8. An image forming apparatus comprising:

an image forming portion which forms an image on a sheet; and a sheet processing apparatus which effects processing on the sheet on which an image has been formed by said image forming portion, said sheet processing apparatus including:

a curling unit which curls an end portion of the sheet;

a stacking portion on which the sheet curled by said curling unit is stacked;

a folding device which is disposed downstream of said curling unit and folds a sheet or a sheet bundle curled by said curling unit;

a sheet bundle conveying portion which conveys the curled sheet or the curled sheet bundle stacked on said stacking portion to said folding device; and a curved guide path which guides the sheet or the sheet bundle conveyed by said sheet bundle conveying portion, wherein said folding device is disposed in said curved guide path, and said curling unit curls the end portion of said sheet in the same direction as a direction of curvature of said curved guide path, and wherein said folding device folds the curled sheet or the curled sheet bundle so that the end portion of the sheet curled by said curling unit may face inwardly.

9. An image forming apparatus according to claim 8, wherein said sheet processing apparatus has a sheet detecting sensor which detects the sheet conveying to said curling unit, wherein said curling unit has a pair of rollers movable toward and away from each other, and wherein said image forming apparatus further comprises:

a controller which controls a timing of movement of said pair of rollers toward and away from each other on the basis of a result of detection by said sheet detecting sensor.

10. An image forming apparatus according to claim 8, further comprising:

a stapler which binds the sheet bundle, wherein said folding device folds a portion of the sheet bundle which has been bound by said stapler.

11. An image forming apparatus according to claim 8, further comprising:

an image reading apparatus which reads an image of an original, said image reading apparatus being disposed above said image forming portion with space between said image reading apparatus and said image forming portion, said sheet processing apparatus being mounted in the space.

* * * * *